United States Patent [19]

Kremar

[11] Patent Number: 4,744,526

[45] Date of Patent: May 17, 1988

[54] CONSTANT TENSION REEL WITH AUTOMATIC REEL BAR LOADER

[75] Inventor: Djuro Kremar, N.D. Ile Perrot, Canada

[73] Assignee: Valmet-Dominion Inc., Lachine, Canada

[21] Appl. No.: 79,878

[22] Filed: Jul. 30, 1987

[51] Int. Cl.[4] ..... B65H 19/30; B65H 18/16; B21C 47/24

[52] U.S. Cl. ..... 242/65; 242/58.6; 242/79

[58] Field of Search ..... 242/65, 58.6, 79, 66

[56] References Cited

U.S. PATENT DOCUMENTS

| | | | |
|---|---|---|---|
| 1,949,997 | 11/1931 | Fourness . | |
| 2,508,566 | 5/1950 | Dunton . | |
| 2,835,372 | 5/1958 | Biddison . | |
| 2,989,262 | 6/1961 | Hornbostel . | |
| 3,062,389 | 11/1962 | Hunter . | |
| 3,239,155 | 3/1966 | Kinoshita | 242/66 |
| 3,586,253 | 6/1971 | Gilbank . | |
| 3,877,654 | 4/1975 | Randpalu et al. . | |
| 4,179,330 | 12/1979 | Page | 242/65 X |
| 4,417,491 | 11/1983 | Uehara et al. . | |
| 4,634,068 | 1/1987 | Malkki et al. | 242/65 |

FOREIGN PATENT DOCUMENTS

| | | |
|---|---|---|
| 875820 | 7/1971 | Canada . |
| 960628 | 1/1975 | Canada . |
| 1009637 | 5/1977 | Canada . |
| 132933 | 10/1962 | U.S.S.R. . |

*Primary Examiner*—John M. Jillions
*Assistant Examiner*—Steven M. duBois
*Attorney, Agent, or Firm*—Raymond A. Eckersley

[57] ABSTRACT

A reel bar loading device is provided having sloping storage rails located above the driving roll. The storage rails have lower ends that collapse bringing the reel into the initial winding contact with the driving roll. Once initial winding contact has been established, a transfer arm can be brought up to engage the reel and move the reel into a second winding position remote from the rails while keeping the reel in winding contact during this movement.

11 Claims, 5 Drawing Sheets

CONSTANT TENSION REEL WITH AUTOMATIC REEL BAR LOADER

FIELD OF THE INVENTION

The present invention relates to a reel loading device adapted to feed reels from upper supporting racks or rails onto transfer arms which move and support the reel in winding position in a paper making machine.

BACKGROUND OF THE INVENTION

A variety of different reel lowering devices for transferring a reel from a supporting rack for storing empty reel bars into a transfer means to move the reel bars into a winding position have been proposed and many such devices are currently in use. For example U.S. Pat. No. 1,949,997 issued Mar. 6, 1934 to Fourness describes a paper winder wherein empty cores are carried from a lower rack via a pair of arms and moved into winding position against a winding drum to form a roll of paper. The shaft of the paper core is transferred from grooves or slots in the arms transferring the core to the winding position into co-operating slots formed in a second pair of transfer arms that carry a finished or wound roll of paper into a second storage rack located above the storage rack for empty reels. This device provides for the loading and unloading of reels and wound paper rolls respectively from a winding position but is a relatively expensive and cumbersome piece of equipment.

U.S. Pat. No. 2,508,566 issued May 23, 1950 to Dunton describes a web roll backstand and provides for a transfer of a wound roll to an unwind station and removal of the cores. A pair of arms are used to make the transfer into the unreeling position and a second pair of arms are used to transfer the empty reel or core to a second storage position. Although this device is not a device for transferring empty reels into a transfer arm it does show the use of spaced arms to make the transfer of the roll into an operating position.

U.S. Pat. No. 2,989,262 issued June 20, 1961 to Hornbostel teaches the use of gravity to roll a plurality of empty cores and apply the cores one at a time from an inclined storage device into a loading position where they are picked up by a transfer arm and moved into winding position between a pair of winding drums. The mechanism for controlling the flow of empty cores down the relatively steep incline of the storage device leads to significant complications in this structure of the winder.

Yet another example of a reel loader is shown in U.S. Pat. No. 3,586,253 issued June 22, 1971 to Gilbank et al. In this device empty reels are loaded onto an upper rack formed by a pair of rails having an abutment stop at their lower ends so the empty reels move down the rails to the abutment stop. A pair of lifting and lowering arms are provided which lifts each empty reel over the abutment and permits it to roll to the opposite side thereof and then lowers the reel into the reel transfer device. The operations of the reel lowering arms in the arrangement require both the lifting over the abutment, transverse movement to direct the reel to the opposite side of the abutment and then lowering of the reel into the transfer device. The opposite side of the abutment in this case operates as a cam to hold the reel in position during the initial phases of lowering of the lowering arms so that there is a controlled movement of the reel along the lowering arms. Obviously the reciprocal motion of the arm during loading complicates the operation of the lowering arms in that they first must move upward to lift the reel bars above the abutment and then downward after the reel bars have moved along the arm to the opposite side of the abutment into a transfer position.

U.S. Pat. No. 3,877,654 issued Apr. 15, 1975 to Randpalu et al. utilizes transfer arms as a transfer device in the normal manner to move a reel bar into winding position and also as a lowering mechanism. The transfer arms are extended so that the clamp may move along the arms to an upper position to receive reels located on the storage rack thereabove. Clearly, such extension of the transfer arms requires a controlled movement of the reels along the storage rack to permit the transfer arms to rotate and requires a more elaborate clamping mechanism which is transported along the transfer arms.

In my copending U.S. patent application Ser. No. 874,160 filed June 13, 1986 there is disclosed a reel bar loader device having a pair of lowering arms onto which the reel bars are loaded one at a time. The lowering arms pivot from an upper position adapted to receive a reel bar on a supporting surface thereof to a lower transfer position while the reel bar rolls along the length of the surface into contact with an abutment on the arms. The reel lowering arms provide a cam stop that moves into stopping position to stop movement of reel bars into a loading position when the lowering arms are not in their upper position.

None of the above reel lowering devices provide for constant nip pressure or tension to be applied to the reel bar as it is lowered into a winding position remote from its initial empty position.

BRIEF DESCRIPTION OF THE INVENTION

It is an object of the present invention to provide a simplified mechanism for lowering the empty reels from the storage racks or rails onto transfer arms wherein the reel maintains controlled nip pressure with the driving roll during this transfer.

It is a further object of the present invention to provide a structure wherein the transfer arms may support the final winding of the wound roll while the new reel is being brought into its initial winding position by the rail support for the empty reels.

In accordance with one aspect of the present invention there is provided a reel bar loader for loading a reel into winding position in a paper making machine. The reel bar loader comprises a rail means sloping downwardly from one end towards the other end thereof for carrying at least one reel. The reel bar loader further includes means for positively locating one reel at the other end of the rail means in a pre-winding position above a driving roll of the paper making machine. There is provided means for collapsing the other end of the rail means to move the reel into a first winding position engaging the driving roll and to control initial nip pressure with the driving roll while the locating means continues to positively locate the one reel on the other end of the rail means. The loader also includes transfer arm means pivotally movable between a first loaded position for accepting the reel from the locating means and a second loaded position positioning the reel in a second winding position remote from the rail means. The transfer arm means includes means for controlling the nip pressure between the reel and the driving roll during pivotal movement from the first loaded position to the second loaded position and for controlling nip pressure between the driving roll and the reel in said second winding position as paper winds into a wound roll on the reel.

Advantage is found with the present invention in that it permits the rail means to transfer the reel directly to the reel winding support structure, the transfer arm means, without the use of an intermediate structure. Further, during this transfer, the reel is brought into paper winding engagement with the driving roll. The collapsing rail means together with the transfer arm continually controls the nip pressure between the reel and driving roll. The arrangement of the present invention allows for a reduction in the floor space required by this loader when compared with papermaking machine reel bar loaders currently in use.

The reel bar loader of the present invention may further include temporary storage rails sloping downwardly away from the second winding position for temporarily storing the wound roll. The transfer arm means may include release means for releasing the reel from the second winding postion to cause the reel and wound roll to roll along the temporary storage rails away from the second winding position. The temporary storage rails may comprise a shock absorber to arrest movement of the reel along the temporary storage rails and a brake shoe to arrest rotating movement of the reel.

The other end of the empty reel support rail means is preferrably pivotally connected to the remaining portion of the rail means. The other end is aligned with the remaining portion of the rail means in the pre-winding position of the rail means. The other end of the rail means slopes downward at a greater angle than the remaining portion of the rail means when the rail means collapses bringing the reel into its first winding postion.

The locating means preferably includes a locating clamping jaw that passes over and partially surrounds the reel. The reel is effectively sandwiched between the rail means and the locating jaw preventing the reel from moving off the other end of the rail means. The locating means may further include a safety abutment means that abuts the reel preventing the reel from moving off the other end of the sloping rail means. The locating jaw is pivotally connected to the reel bar loader and to first piston means. The locating jaw pivots with the collapse of the other end of the rack and the first piston means exerts force on the locating jaw to maintain the jaw in contact with the reel so as to positively locate the reel against the other end of the rail means.

The collapsing means preferrably includes second piston means pivotaly connected to one end of first and second support arms; the first support arm having its other end pivotally connected to the other end of the rail means and the second support arm having its other end pivotally connected to the reel bar loader. The second piston means maintains the first and second support arms in alignment to support the rack in its pre-winding position and the second piston means movable to angle the first and second support arms relative to each other to cause the rack to collapse moving the reel downwardly into contact with the driving roller.

The transfer arm means preferably includes a transfer jaw adapted to partially surround the reel. The nip pressure control means comprises a piston means connected at one end to the transfer jaw and at its other end to the axis of the driving roll. The transfer jaw perferably includes a shoe that is pivotally mounted thereto and a shoe piston means. The shoe piston means is pivotally connected to the shoe such that the shoe pivots due to movement of the shoe piston means resulting in the shoe moving the reel onto the temporary storage rail means.

BRIEF DESCRIPTION OF THE DRAWINGS

For a better understanding of the nature and objects of the present invention referrence may be had by way of example to the accompanying diagrammatic drawings in which.

DESCRIPTION OF THE PREFERRED EMBODIMENTS

Figure 1:
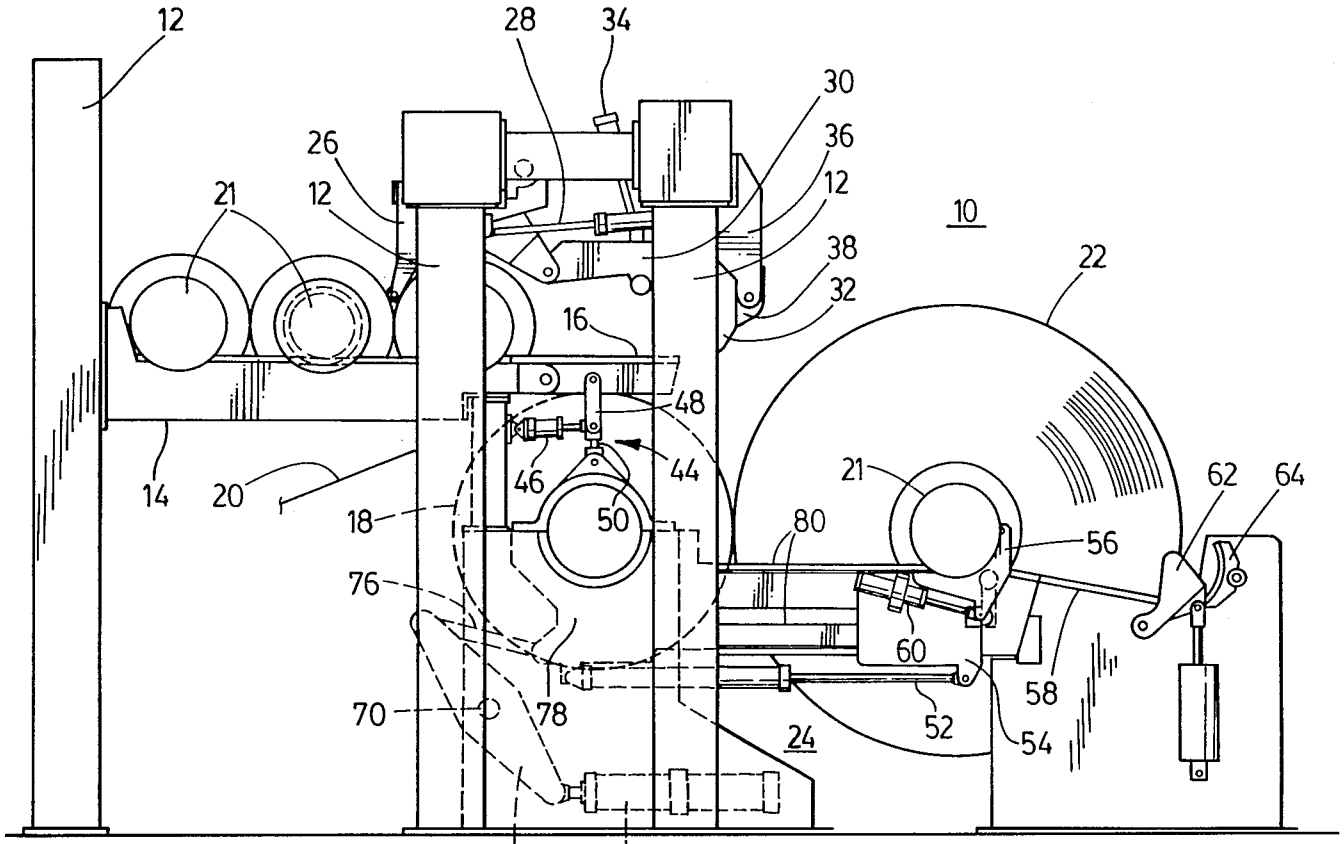
FIG. 1 is a schematic side elevation illustrating the present invention and the operation thereof.

Referring to FIG. 1, there is shown generally at 10 a winding station for a paper making machine. The winding station comprises a plurality of support columns 12 supporting sloping rails or racks 14. It should be understood that while only one side of the winding station is illustrated, the other side of the machine corresponds to the side described. The rail 14 slopes at a predetermined angle of approximately 2° towards a collapsible end 16. The collapsible end 16 of rail 14 is located above driving roll 18 of a papermaking machine. A web of paper shown generally at 20 passes over the driving roll and is wound onto reel 21 to form a wound roll 22. The reel 21 is moved from the collapsible end 16 of rail 14 by means of a transfer arm mechanisim 24. The transfer arm 24 carries the reel over the driving roll in paper winding engagement therewith as the transfer arm lowers the reel 21 into a winding position remote from the rail 14. In this position paper continues to be wound onto the reel 21 to form the wound roll 22.

The present invention is directed to the movement of the reel 21 from its pre-winding position through to its wound position. This involves the novel manner in which the rail ends 16 collapse and the manner in which the transfer arm means rises to accept the reel 21 from the collapsed rails 16.

It should be understood that empty reel bars are loaded onto the sloped loading rails 14 by means of a crane. Arms 26 attached to columns 12 control the movement of the reels 21 from the ends of the rails 14 over the collapsible end rails 16. As the wound roll 22 completes its winding, loading arms 26 push a reel bar 21 into position at the end of the collapsible end rail 16. The arms 26 are moved by contraction of hydraulic cylinder-piston arrangement 28. As the reel 21 is pushed towards the end of the collapsible rail 16, it engages a clamp 30 and pushes the clamp up into the position shown in FIG. 2. The clamp 30 includes jaw 32 that partially surrounds the reel 21 so as to sandwich the reel 21 between the clamp 30 and collapsible rails 16. The clamp 30 is pivotally connected to the winding station and movement thereof can be actuated by cylinder-piston mechanism 34. In FIG. 1, the cylinder-piston mechanism 34 is not energized. There is also provided a safety abutment structure 36 including a stop plate 38 pivotally attached thereto. The stop plate 38 is a safety feature which prevents the reel 21 from falling off the end of the sloping collapsible end rail 16 in the event the controls and interlocks of a control system for the loader fails. In FIG. 1, the collapsible end rail 16 is shown in the pre-winding positon in alignment with the remaining portion of the sloped loading rail 14.

The collapsible end rail 16 is supported in the pre-winding position by collapsing means 44. Collapsing means 44 comprises a cylinder-piston means 46 which has a piston pivotally connected to the mutual pivotal connection of a first support arm 48 and a second support arm 50. The first support arm is pivotally connected at its other end to the collapsible end rails 16. The second support arm 50 is pivotally connected at its other end to the winding station above the axis of the driving roll 18.

To load the empty reel 21 into its first winding position, it should be understood that the reel is first moved to the collapsible end 16 of rail 14. In this pre-winding position, the paper machine is now ready to effect the transfer of the winding of paper being wound onto the wound roll 22 to the reel 21. To lower the reel 21 onto the driving roll 18, the collapsing means 44 is controlled to pull the piston 46 into the cylinder so that the supporting arms 48, 50 are moved out of alignment into an angled open V configeration. This results in the collapsible end rail 16 becoming more inclined than the slope with the remaining rail 14. Simultaneously, cylinder 34 is energized expanding its piston to push down on the clamp 30. Clamp 30 pivots with respect to the winding station and maintains its clamping relation with the reel bar 21. Prior to the collapsing of rails 16, the reel bar 21 will be pre-started and brought up to rotating speed corresponding to that of the speed of rotation of the driving roll 18. As the rail 16 is lowered the reel 21 comes into contact with a driving roll 18. At this time, a knife (not shown) will cut the paper so that the paper will commence winding on the lowered reel 21. The collapsing means 44 together with piston-cylinder arrangement 34 control the initial nip pressure of the reel 21 against driving roll 18.

Once the reel has been initially loaded on the driving roll, the transfer arm mechanism first releases the wound roll and then moves to accept the new reel 21.

Figure 2:
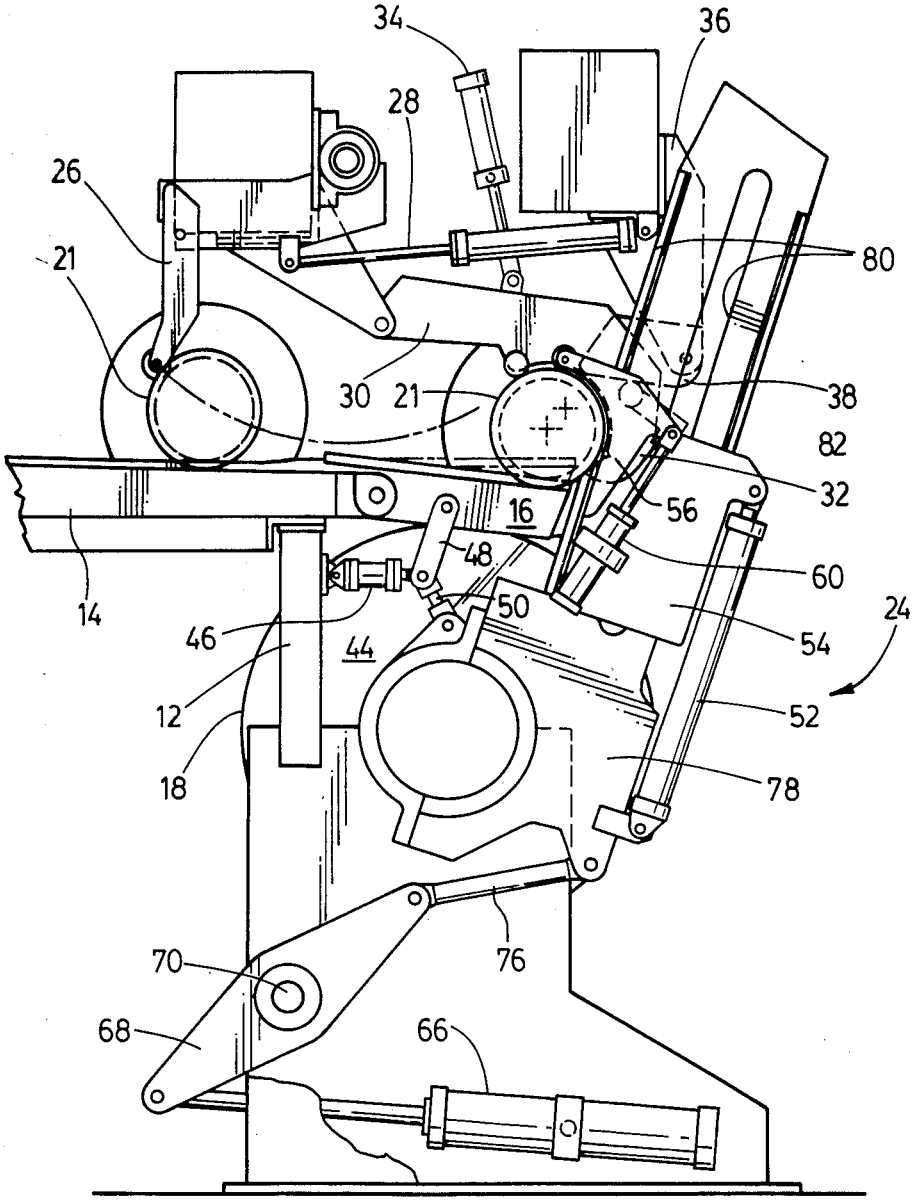
FIG. 2 is a partial schematic side elevation of the present invention showing the rail means in its collapsed positon and the reel in its first winding position.
Figure 3:
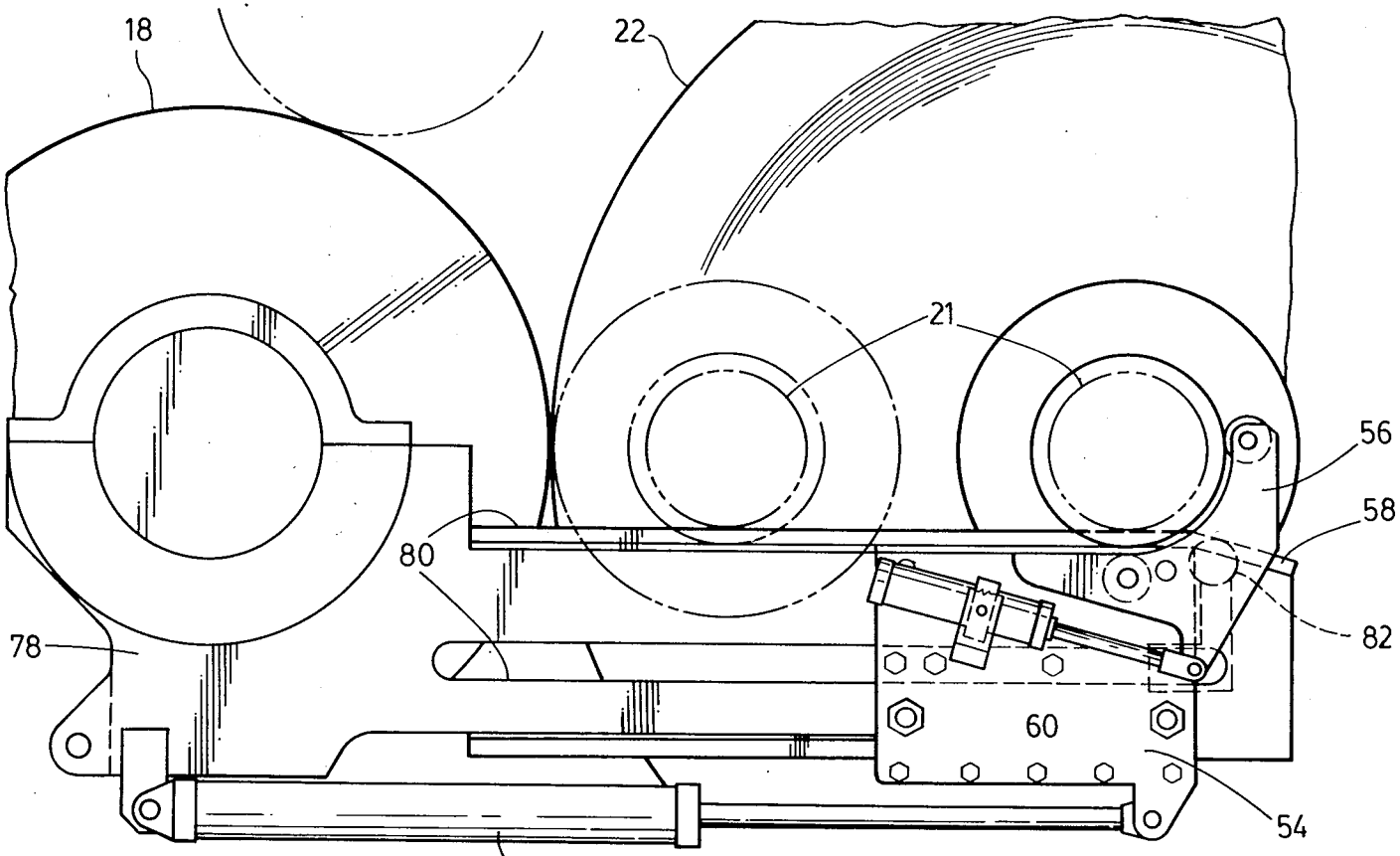
FIG. 3 is is a partial schematic side elevation of the present invention showing the transfer arm in its second winding position.

The transfer arm includes a cylinder-piston arrangement 52 which is pivotally attached to a clamp or jaw 54. The jaw 54 includes a shoe 56 which supports the reel 21. In FIG. 2, it can be seen that the cylinder-piston 52 extends and contracts to control the nip pressure between the paper being wound onto reel 21 and the driving roll 18. Once the reel 21 has been initially loaded on the driving roll 18, the wound roll 22 is moved onto temporary rails 58 located adjacent shoe 56. This is accomplished by means of a piston-cylinder arrangement 60 which is pivotally connected at one end to the jaw 54 and has a piston pivotally connected to one end of shoe 56. Shoe 56 is also pivotally connected to the jaw 54. When the piston-cylinder arrangement 60 contracts, the shoe 56 rotates relative to the jaw 54 and kicks the wound roll 22 onto the temporary rails 58. This rotating wound roll has a considerable amount of inertia associated with it and will roll down the sloped temporary rail 52 coming into contact with a shock absorber shown generally at 62. The shock absorber will ease the downward rolling motion of the roll into a rigid brake shoe 64. The brake shoe 64 should stop the rotation of the wound roll 22 in approximately 50 seconds.

Once the shoe 56 has moved the wound roll 22 onto the temporary rails 58, the shoe then moves back into its original position shown in FIG. 1 by extension of the cylinder-piston arrangement 60. The transfer arm mechanism 24 then pivots about the axis of the driving roll 18 by means of cylinder-piston arrangement 66 extending the piston causing a link arm 68 to pivot about pivot point 70. The other end of the link arm 68 is pivotally connected to a further link arm 76 which is connected to the rotating hub 78 of the transfer arm mechanism. The rotating hub 78 is further connected to the shoe 56 and jaw 54 by the cylinder-piston arrangement 52 and supporting sliding rail 80. As the piston 66 extends, the shoe 56 and jaws 54 of the transfer arm 24 come up and engage the reel 21 in its first winding position. In so doing, a roller mechanism 82 pushes against the stop plate 38 to pivot it about its pivotal connection to abutment 36 and moves the stop plate 32 out of the way. Once the shoe 56 engages the reel 21, the cylinder 34 attached by its piston to clamp 30 retracts its piston releasing the reel from the clamp 30.

Figure 4:
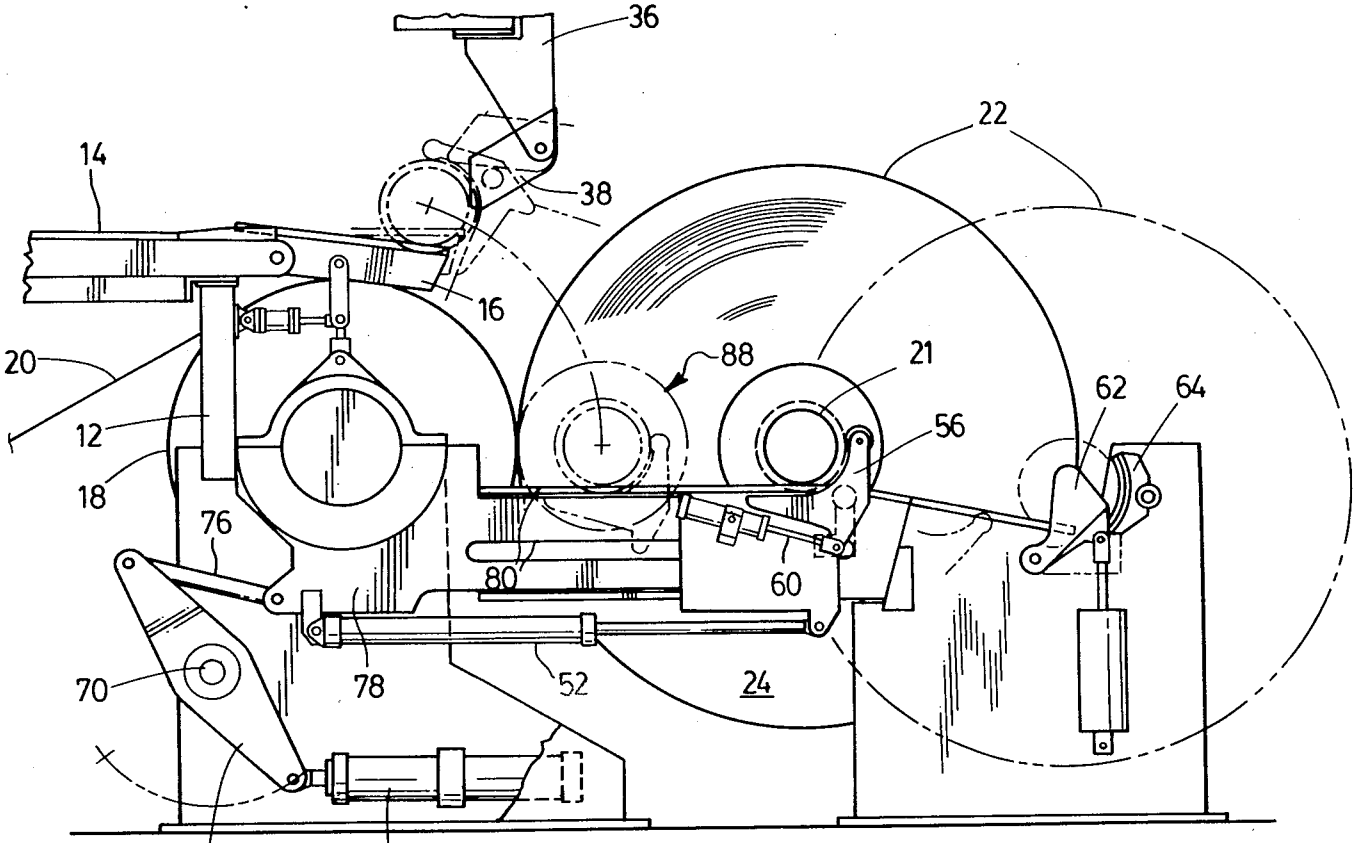
FIG. 4 is a further schematic side elevation view of the present invention showing the movement of the transfer arm.
Figure 5:
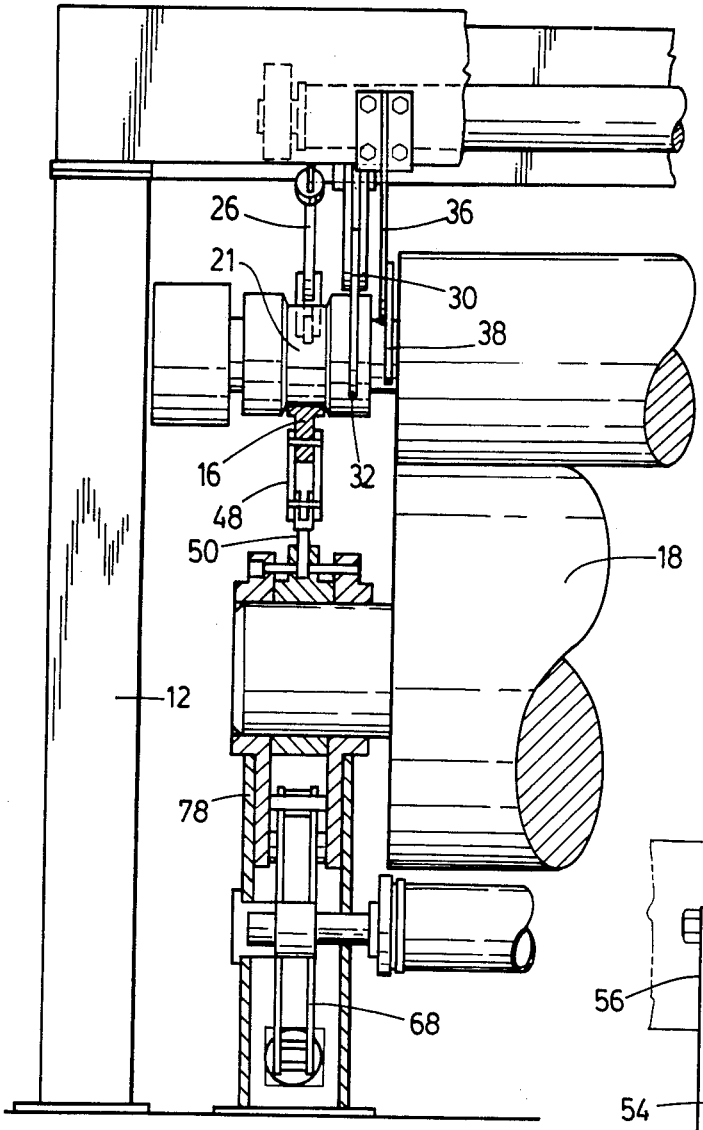
FIGS. 5 and 6 are partial end views of the present invention.
Figure 6:
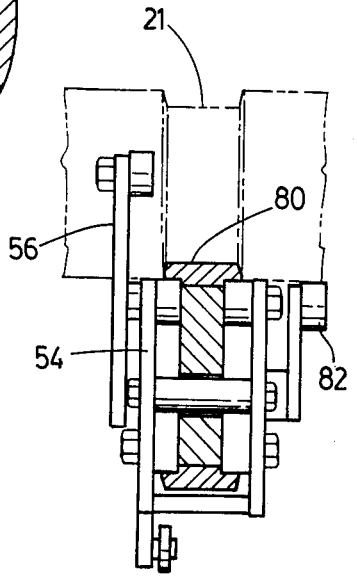

At this point in the transfer, the reel is supported by the shoe 56 of the transfer arm mechanism 24. The transfer arm 24 then rotates back down to a position shown at 88 in FIG. 4. This is accomplished by the cylinder-piston arrangement 52 contracting and maintaining the nip pressure between the reel 21 and driving roll 18 constant while the cylinder-piston arrangement 66 contracts causing the transfer arm to rotate about the axis of the driving roll 18. Once the cylinder-piston 66 is contracted, the reel 21 will be in a second winding position. During this second winding position, the cylinder piston arrangement 52 will control the force that the shoe 56 maintains between the reel 21 and the driving roll 18. It should be understood that the jaw 54 and the reel are adapted to slide along rails 80 as the piston-cylinder arrangement 52 expands and contracts. As the paper continues to wind on reel 21, the roll diameter increases, increasing the distance between the axis of winding drum 18 and reel 21.

The transfer of the arm mechanism upward to accept the reel 21 and the movement of the reel into a second winding position remote from the rails 14 takes approximately 5 to 8 seconds. Once the transfer arm mechanism is in a second winding position, it will continue to wind the paper onto the roll. Subsequent to the transfer, the wound roll located at the brake 64 is removed by means of a crane.

What I claim as new and desire to secure by Letters Patent of the United States is:

1. A reel bar loader for loading a reel into winding position in a paper making machine, comprising:

rail means sloping downwardly from one end towards the other end thereof for carrying at least one reel;

means for positively locating one reel at the other end of the rail means in a pre-winding position above a driving roll of the paper making machine;

means for collapsing the other end of the rail means to move the reel into a first winding position engaging the driving roll and to control initial nip pressure with the driving roll while the locating means continues to positively locate the one reel on the other end of the rail means; and, transfer arm means pivotally movable between a first loaded position for accepting the reel from the locating means and a second loaded position positioning the reel in a second winding position remote from the rail means, said transfer arm means including means for controlling the nip pressure between the reel and the driving roll during pivotal movement from the first loaded position to the second loaded position and for controlling nip pressure between the driving roll and the reel in said second winding position as paper winds into a wound roll on said reel.

2. The reel bar loader of claim 1 further including temporary storage rail means sloping downwardly away from the second winding position for temporarily storing the wound roll and wherein the transfer arm means includes release means for releasing said reel from said second winding position to cause said reel and wound roll to roll along said temporary storage rail means away from the second winding position.

3. The reel bar loader of claim 2 wherein said temporary storage rail means has located at one end thereof a shock absorber to arrest movement of said reel along said temporary storage rail means and a brake shoe to arrest rotating movement of said reel.

4. The reel bar loader of claim 1 wherein the other end of said rail means is pivotally connected to the remaining portion of said rail means, the other end of the rail means sloping downwardly at a greater angle than the remaining portion of the rail means when the other end is collapsed.

5. The reel bar loader of claim 4 wherein the collapsing means includes second piston means pivotaly connected to one end of first and second support arms, the first support arm having its other end pivotally connected to the other end of said rail means, the second support arm having its other end pivotally connected to the reel bar loader, the second piston means maintaining the first and second support arms in alignment to support the rail means in its pre-winding position and the second piston means being movable to angle the first and second support arms relative to each other to cause the rail means to collapse moving the reel downwardly into contact with the driving roller.

6. The reel bar loader of claim 1 wherein the locating means comprises a locating clamping jaw that passes over and partially surrounds the reel, the reel being effectively sandwiched between the rail means and the jaw preventing the reel from moving off the other end of the rail means.

7. The reel bar loader of claim 6 wherein the locating means further includes a safety abutment means that abuts the reel preventing the reel from moving off the other end of the sloping rail means.

8. The reel bar loader of claim 6 wherein the locating jaw is pivotally connected to the reel bar loader and to first piston means, the locating jaw pivoting during collapsing of the other end of the rail means and the first piston means exerting force on the locating jaw to maintain the locating jaw in contact with the reel so as to positively locate the reel against the other end of the rail means.

9. The reel bar loader of claim 6 wherein the collapsing means includes second piston means pivotaly connected to one end of first and second support arms, the first support arm having its other end pivotally connected to the other end of the rail means, the second support arm having its other end pivotally connected to the reel bar loader, the second piston means maintaining the first and second support arms in alignment to support the rail means in its pre-winding position and the second piston means being movable to angle the first and second support arms relative to each other to cause the rail means to collapse moving the reel downwardly into contact with the driving roller.

10. The reel bar loader of claim 1 wherein the transfer arm means includes a transfer jaw adapted to partially surround the reel, and the nip pressure control means comprises tension control piston means connected at one end to the jaw and at its other end to the axis of the driving roll around which said transfer arm means pivots.

11. The reel bar loader of claim 10 further including temporary storage rail means and wherein the transfer arm means includes release means comprising a shoe that is pivotally mounted to the transfer jaw and shoe piston means, the shoe piston is pivotally connected to the shoe to cause the shoe to pivot and move the reel onto the temporary storage rail means.

* * * * *